US009059571B2

(12) United States Patent
Hartmann et al.

(10) Patent No.: US 9,059,571 B2
(45) Date of Patent: Jun. 16, 2015

(54) SPARK PLUG HAVING A SIDE-MOUNTED GROUND ELECTRODE

(75) Inventors: Detlef Hartmann, Bamberg (DE); Andreas Benz, Bamberg (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 14/346,444

(22) PCT Filed: Aug. 2, 2012

(86) PCT No.: PCT/EP2012/065110

§ 371 (c)(1), (2), (4) Date: Jun. 23, 2014

(87) PCT Pub. No.: WO2013/045140

PCT Pub. Date: Apr. 4, 2013

(65) Prior Publication Data

US 2014/0292178 A1 Oct. 2, 2014

(30) Foreign Application Priority Data

Sep. 26, 2011 (DE) ..... 10 2011 083 452

(51) Int. Cl.

| | |
|---|---|
| ***H01T 13/32*** | (2006.01) |
| ***H01T 13/06*** | (2006.01) |
| ***H01T 13/20*** | (2006.01) |
| ***H01T 13/39*** | (2006.01) |
| ***H01T 21/02*** | (2006.01) |

(52) U.S. Cl.

CPC ..... *H01T 13/06* (2013.01); *H01T 13/20* (2013.01); *H01T 13/39* (2013.01); *H01T 21/02* (2013.01); *H01T 13/32* (2013.01)

(58) Field of Classification Search

CPC ..... H01T 13/32; H01T 13/52
USPC ..... 313/118–145
See application file for complete search history.

(56) References Cited

U.S. PATENT DOCUMENTS

| | | | | |
|---|---|---|---|---|
| 5,448,130 | A * | 9/1995 | Matsutani et al. | 313/141 |
| 5,502,351 | A | 3/1996 | Hartmann et al. | |
| 2009/0066211 | A1 | 3/2009 | Katoh et al. | |

FOREIGN PATENT DOCUMENTS

| | | |
|---|---|---|
| DE | 10 2004 050164 | 4/2006 |
| DE | 10 2007 042790 | 3/2009 |
| EP | 549368 | 6/1993 |
| EP | 0 588 495 | 3/1994 |
| GB | 2 277 555 | 11/1994 |
| JP | H 05114455 | 5/1993 |
| JP | H 0845643 | 2/1996 |
| JP | 2005100747 | 4/2005 |

OTHER PUBLICATIONS

International Search Report for PCT/EP2012/065110, dated Nov. 19, 2012.

* cited by examiner

*Primary Examiner* — Anne Hines
(74) *Attorney, Agent, or Firm* — Kenyon & Kenyon LLP

(57) ABSTRACT

A spark plug includes: a center electrode, a ground electrode, which is side-mounted on the center electrode, and a noble metal insert, which is situated on the center electrode. The noble metal insert is situated in a cutout provided in a base material of the center electrode and connected in a continuous material to the base material of the center electrode. The noble metal insert is directed with one surface towards the side-mounted ground electrode.

12 Claims, 2 Drawing Sheets

SPARK PLUG HAVING A SIDE-MOUNTED GROUND ELECTRODE

BACKGROUND OF THE INVENTION

1. Field of the Invention

The present invention relates to a spark plug having a ground electrode that is placed against its side and a center electrode having a noble metal insert.

2. Description of the Related Art

Spark plugs in diversified embodiments are known from the related art. Because of the electrical and physical forces acting particularly on the electrodes, the electrodes are exposed to increased wear compared to other component parts. In order to reduce the wear, pins made of noble metal are therefore frequently applied to the electrodes. A spark plug having a ground electrode mounted against its side is known from published German patent application document DE 102007042790 A1, for example. Compared to spark plugs that are also known, having top electrodes, such spark plugs having side-mounted ground electrodes have the advantages of better inflammation and a reduction in the ground electrode temperature based on the shorter electrode length in comparison to a top electrode. The use of noble metal pins on the ground electrode and the center electrode is very costly, however. It would therefore be desirable to have a spark plug using a reduced quantity of noble metal.

BRIEF SUMMARY OF THE INVENTION

The electrode according to the present invention has the advantage that a required quantity of noble metal or metal alloys is able to be reduced significantly, compared to the related art. The spark plug according to the present invention is thereby able to be produced clearly more cost-effectively, without reducing its service life. This is achieved according to the present invention in that the spark plug has a side-mounted ground electrode and a center electrode having a noble metal insert. In this connection, the noble metal insert is situated in a cutout provided in the center electrode in a base material of the center electrode. The noble metal insert, in this context, is situated on the outer circumference of the center electrode in such a way that the noble metal insert is directed with one surface towards the ground electrode. Consequently, wear of the center electrode is able to be reduced by the noble metal insert directed towards the ground electrode, without large quantities of noble metal being required. The noble metal insert, in this context, is able to be made completely of noble metal, or it may be an alloy containing noble metal. The base material is preferably a cost-effective nickel alloy. The noble metal insert is connected in continuous material to the base material, and situated on the center electrode in such a way that it is directed towards the ground electrode, so that a spark arc-over takes place between the noble metal insert and the ground electrode. On the ground electrode noble metal is preferably also situated, preferably in the form of a pin.

In order to provide a very high durability of the spark plug, a projection of an end face, of the ground electrode, directed towards the center electrode, lies completely on the noble metal insert. This makes certain that the spark arc-over occurs at the noble metal-containing electrode surface of the center electrode.

Further preferred, the cutout in the center electrode is a groove running in parallel to a center axis of the center electrode. Particularly preferred, the cutout is a groove impressed into the center electrode. Further preferred, the groove has a bow-shaped form in section, before the welding process.

According to one further preferred embodiment of the invention, the center electrode has a recess directed towards the ground electrode. In this context, the noble metal insert is situated on the recess of the center electrode. The recess is provided by an essentially planar area directed towards the ground electrode, in which the cutout is provided. In an especially preferred manner, a first and second region of base material is present on the recess on both sides, in the circumferential direction of the noble metal insert. Thereby a wear area of the center electrode may be enlarged, since, in addition to the surface of the noble metal insert, the base electrode material may also be drawn upon as a wear area which is present on both sides of the noble metal insert. A further advantage is obtained by an enlarged, lateral covering tolerance perpendicular to the longitudinal axis of the center electrode to the ground electrode.

Further preferred, a welded connection is developed between the noble metal insert and the base material of the center electrode. The welded connection is preferably produced using a laser.

A maximum depth is preferred, of the noble metal insert from the surface in the direction towards the center axis of the center electrode, less than or equal to the length of an exposed surface of the noble metal insert, in the circumferential direction, directed towards the ground electrode. This ensures that as small a quantity of noble metal as possible is used in the center electrode.

Furthermore, the present invention relates to producing a center electrode of a spark plug having a side-mounted ground electrode. In this context, according to the present invention, the steps are carried out of providing a center electrode from a base material having a cutout, of situating a noble metal insert in the cutout and of producing a continuous material connection of the noble metal insert to the base material using a laser. The continuous material connection of the noble metal insert to the base material takes place, in this instance, preferably in such a way that the noble metal insert completely fills up the cutout in the base material. The laser, in this context, is preferably directed directly onto the end face of the noble metal insert, in order to produce the continuous material connection. A noble metal alloy is preferably produced, in this case, by mixing the noble metal and the base material. The laser is alternatively directed to the back side, opposite the noble metal insert, on the center electrode. A heat input into a connecting region between the noble metal insert and the base material may thereby take place all the way through the base material. Because of this, particularly the fastening may be enabled of a pure noble metal insert to the base material, so that the noble metal insert has a pure noble metal surface.

The cutout in the base material is preferably applied to the base material using an impressing step. A groove is preferably impressed in this context. Further preferred, a cylindrical noble metal wire is inserted into the cutout, the noble metal wire having a diameter of 0.3 to 0.6 mm, preferably 0.45 to 0.55 mm and particularly preferred, approximately 0.5 mm.

The noble metal insert is preferably made of platinum and/or iridium and/or rhodium and/or rhenium and/or alloys of these elements.

BRIEF DESCRIPTION OF THE INVENTION

Figure 1:
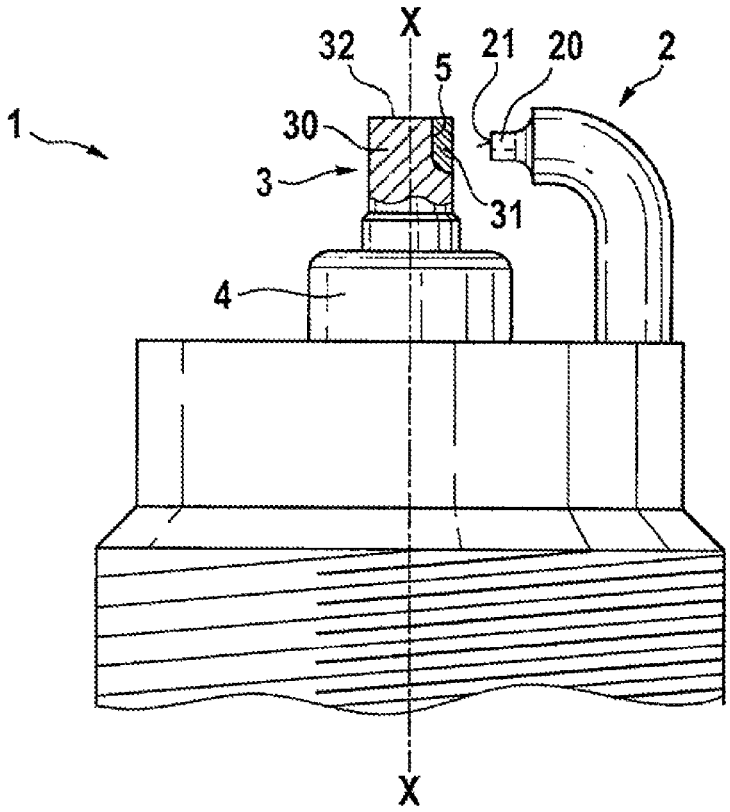
FIG. 1 shows a schematic, partially sectioned view of a part of a spark plug according to a first exemplary embodiment of the present invention.
Figure 2:
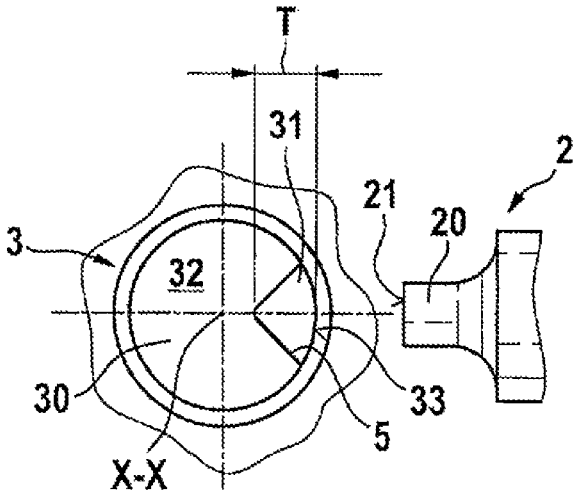
FIG. 2 shows a schematic top view of the spark plug of FIG. 1.

With reference to FIGS. 1 and 2, a spark plug 1 according to a first preferred exemplary embodiment of the present invention is described in detail below.

As may be seen in FIG. 1, spark plug 1 includes a side-mounted ground electrode 2, a cylindrical center electrode 3 and an insulating element 4. The figures show only the parts of the spark plug that are essential to the present invention. Side-mounted ground electrode 2 includes a noble metal pin 20, which is directed perpendicular to a center axis X-X of the spark plug towards center electrode 3.

Center electrode 3 includes a base material 30 and a noble metal insert 31, which is situated in a cutout 5 in base material 30. As may particularly be seen in FIG. 2, noble metal insert 31 is provided so that entire cutout 5 is filled up by noble metal insert 31. Moreover, noble metal insert 31 has a surface 33, which is formed corresponding to the outer circumference of center electrode 3. Noble metal insert 31 is provided here in such a way that a projection of an end face 21 of ground electrode 2 lies completely on the surface 33 of noble metal insert 31.

As may further be seen in FIG. 1, noble metal insert 31 runs, starting from an end face 32 of the center electrode, in parallel to center axis X-X.

Consequently, in center electrode 3 according to the present invention, only a small part of the center electrode has to be produced from a costly noble metal or a noble metal alloy. In this context, the maximum depth T of noble metal insert 31 is less than the circumferential arc length of surface 33, of noble metal insert 31, that is exposed to the ground electrode. Because of cutout 5 it is ensured that a sufficient material thickness is present in the vicinity of the shortest connection between center electrode 3 and ground electrode 2, so that a sufficient thickness of the insert containing the noble metal is present in order for a long service life of the spark plug to be attained.

The length of noble metal insert 31 in the direction of center axis X-X of the center electrode is preferably equal to, or greater than the diameter of an end face of ground electrode 2 directed towards the center electrode. That is, if a pin, or the like, is provided on the ground electrode, the length of the noble metal insert is greater than, or equal to the diameter of the pin.

Figure 5:
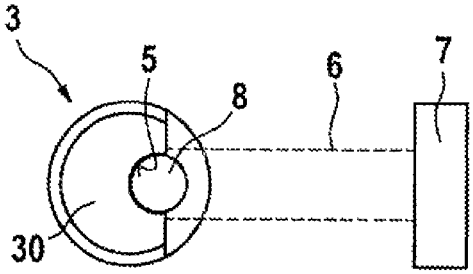
FIGS. 5 and 6 show schematic representations of two alternative production methods for producing a center electrode having a noble metal insert.
Figure 6:
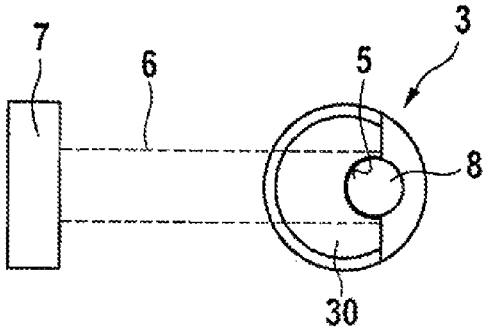

In this instance, noble metal insert 31 is connected in a continuous material to base material 30 of center electrode 3, using a laser. Two alternative production methods are illustrated in FIGS. 5 and 6. In both production methods a groove is produced that is arched in section, so that noble metal wire 8, that is circular in section, is able to lie well against the groove, and there is no air present between the groove and the noble metal wire, to guard against cavitation. In particular, the noble metal wire is impressed into the groove. The shape of the groove changes during the welding process.

In the production method shown in FIG. 5, a laser beam 6, starting from a laser beam source 7, is directed directly on a noble metal wire 8 situated in cutout 5. In the process, laser beam 6 is directed in a lateral alignment at the noble metal wire at which, later, side-mounted ground electrode 2 will be situated. Because of this, there takes place a rapid and reliable continuous material connection between noble metal wire 8 and base material 30, in particular, mixing being also able to take place of the noble metal material of noble metal wire 8 with base material 30, so that, in the finished center electrode, the noble metal insert is a noble metal alloy. The shape of the groove after welding at the front side is essentially V-shaped in section.

In the alternative production method shown in FIG. 6, laser beam 6 is directed to center electrode 3 from a back side of the center electrode with respect to the noble metal insert. This results in a continuous material connection between base material 30 and noble metal wire 8 all the way through base material 30. Thereby one is able to avoid particularly the mixing of base material 30 and the material of the noble metal electrode in the vicinity of surface 33 of noble metal insert 31. Mixing takes place only in the vicinity of cutout 5 for the continuous material connection between base material 30 and the noble metal insert. Consequently, one of the methods described may be used, depending on the embodiment desired of noble metal insert 31.

Thus, according to the present invention, it may also be determined by the selection of the method, whether a noble metal wire 8, made of pure noble metal, is to be fixed in pure form on center electrode 3 (backward laser welding), or whether a noble metal alloy, produced using laser welding, should be used as noble metal insert 31 (direct (front side) laser welding).

Figure 3:
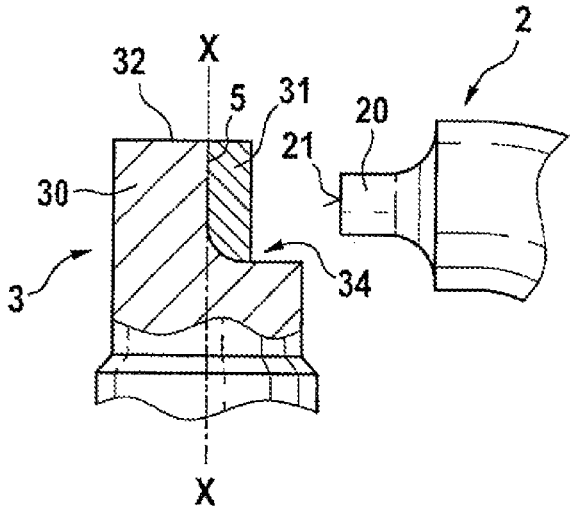
FIG. 3 shows a schematic representation of a part of a spark plug according to a second exemplary embodiment of the present invention.
Figure 4:
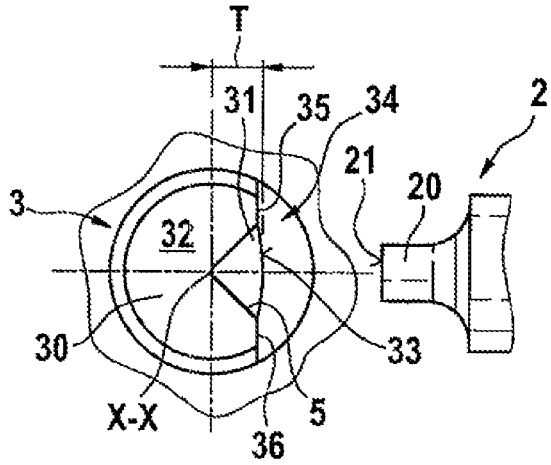
FIG. 4 shows a schematic top view of the spark plug of FIG. 3.

In FIGS. 3 and 4, a spark plug 1 is shown in detail, according to a second exemplary embodiment of the present invention. The same or functionally the same parts are designated by the same reference numerals as in the first exemplary embodiment.

As may particularly be seen from FIG. 4, center electrode 3 has a recess 34. Noble metal insert 31 is provided on recess 34, in this instance. As may further be seen in FIG. 4, noble metal insert 31 is provided centrically on recess 34, in this instance. Thereby, there comes about on both sides of noble metal insert 31, in the circumferential direction, a first region 35 and a second region 36 of base material 30, which are exposed in the direction towards ground electrode 2. This yields an enlargement of a wear area on center electrode 3, since, besides surface 33 of noble metal insert 31, first and second regions 35, 36 of recess 34 are also available as wear areas. One additional advantage of this exemplary embodiment is that a lateral covering tolerance is enlarged perpendicular to longitudinal axis X-X of the center electrode to pin 20 of ground electrode 2.

What is claimed is:

1. A spark plug, comprising:

a center electrode;

a ground electrode side-mounted on the center electrode; and a noble metal insert situated on the center electrode, wherein the noble metal insert is (i) situated in a cutout provided in a base material of the center electrode, wherein the cutout is a groove running parallel to a center axis of the center electrode and extends starting from an end face of the center electrode, (ii) connected in continuous material to the base material of the center electrode, and (iii) directed with one surface towards the side-mounted ground electrode.

2. The spark plug as recited in claim 1, wherein a projection of an end face of the ground electrode directed towards the center electrode lies completely on the one surface of the noble metal insert.

3. The spark plug as recited in claim 2, wherein the center electrode has a recess on a side directed towards the ground electrode, and wherein the noble metal insert is situated on the recess.

4. The spark plug as recited in claim 3, wherein, on the recess on both sides of the noble metal insert in the circumferential direction, in each case a region made of base material and directed towards the ground electrode is provided.

5. The spark plug as recited in claim 3, wherein a welding connection is provided between the noble metal insert and the base material of the center electrode.

6. The spark plug as recited in claim 2, wherein a maximum depth of the noble metal insert from the one surface of the noble metal insert in the direction towards the center axis of the center electrode is no greater than a circumferential arc length of the one surface of the noble metal insert which is exposed in the circumferential direction of the center electrode.

7. A method for producing a center electrode of a spark plug having a side-mounted ground electrode, comprising:

providing a center electrode made of a base material having a cutout;

placing a noble metal insert into the cutout;

wherein the cutout is a groove running parallel to a center axis of the center electrode and extends starting from an end face of the center electrode; and producing, using a laser, a continuous material connection between the noble metal insert and the base material.

8. The method as recited in claim 7, wherein the laser is directed directly onto the noble metal insert, in order to produce the continuous material connection.

9. The method as recited in claim 7, wherein the noble metal insert is produced from a noble metal alloy by the direct laser welding.

10. The method as recited in claim 8, wherein the cutout is applied to the base material of the center electrode using impressing.

11. The method as recited in claim 10, wherein an essentially cylindrical noble metal wire is laid into the cutout.

12. The method as recited in claim 7, wherein the laser is directed at a side of the base material which is at the back of the noble metal insert in order to achieve a back side welding of the noble metal insert to the base material.

* * * * *